US006591940B2

(12) United States Patent
Desjardins

(10) Patent No.: US 6,591,940 B2
(45) **Date of Patent: *Jul. 15, 2003**

(54) SLIDING RAIL ANCHOR SAFETY DEVICE

(76) Inventor: Norman Desjardins, c/o 945 B Cambrian Heights, Sudbury, Ontario (CA), P3C 5M6

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/238,775

(22) Filed: Jan. 27, 1999

(65) Prior Publication Data

US 2003/0006095 A1 Jan. 9, 2003

(51) Int. Cl.[7] ..... A62B 35/00
(52) U.S. Cl. ..... 182/36; 182/3; 248/228.4
(58) Field of Search ..... 182/36, 3; 248/228.4

(56) References Cited

U.S. PATENT DOCUMENTS 2,708,557 A * 5/1955 Clark ..... 248/228.4
2,765,139 A * 10/1956 White
4,606,430 A * 8/1986 Roby et al. ..... 248/228.4
4,767,091 A * 8/1988 Cuny ..... 248/228.4
6,009,973 A * 1/2000 Woodyard ..... 182/36

FOREIGN PATENT DOCUMENTS

GB 648543 * 1/1951 ..... 248/228.4

* cited by examiner

*Primary Examiner*—Alvin Chin-Shue
(74) *Attorney, Agent, or Firm*—Robert G. Hendry; Robert A. Wilkes; Harold C. Baker

(57) ABSTRACT

The invention relates to a sliding rail anchor safety device which is slidably mounted to the rail of a railway track. The device consists of a pair of pivotally interconnected jaw like members which defines claw-like structure which is configured to securely, yet slidably engage the rail of a railway track. A locking arm including a pair of alignable apertures defines a bore which receives a karabiner, which is turn connected to a worker's safety belt or tether.

1 Claim, 2 Drawing Sheets

SLIDING RAIL ANCHOR SAFETY DEVICE

The invention relates to a safety anchor device for use by workers who job requires them to perform tasks along a railway line. Since railway tracks are often located along bridges or overpasses, such workers must often walk or work along narrow passages or spaces which are suspended from a height, and are at risk of serious injury or death if they lose their balance or fall.

Accordingly, it is necessary that such workers have a safety device which enables them to be harnessed or tethered to a secure structure, so that any fall is broken. At the same time, any such safety device must provide the worker with adequate freedom of movement so as not to unduly impede his ability to perform the requisite work.

The prior art has addressed this problem by providing means for tethering the worker to the rail of the railway track. A lanyard or tether is worn by the worker and is securely connected to the rail. In order to be practical, such devices must be securely fastened to the rail so as to prevent accidental disengagement of the device from the rail, while allowing the device to move along the rail, so as not to unduly impede the mobility of the worker.

U.S. Pat. No. 5,271,481 to Rich discloses a rolling restraint device which consists of a lockable hinged frame and a roller which bears against the surface of a structure, preferably the top of the rail, enabling the device to be rolled along the rail as the person to whom the device is tethered moves along or proximate to the rail.

U.S. Pat. No. 3,217,833 to Smith teaches a device which engages a beam or rail and features a means of pivotally adjusting the angle at which the worker is tethered, relative to the surface of the rail or beam.

U.S. Pat. No. 5,526,896 to O'Rourke teaches a fall arrest line anchor comprised of two plates which must be aligned and clamped together using a nut and bolt arrangement.

U.S. Pat. No. 4,606,430 to Roby teaches a rail mounted safety restraint device comprising a substantially U-shaped hood having a pair of hinged hood sections, each of which support a pair of upper and lower rollers to which engager the upper and lower surfaces of the ball of the rail.

U.S. Pat. No. 4,767,091 to Cuny teaches an antifall safety device comprising a sliding I-beam anchor consisting of a pair of C-shaped sections equipped with side beam rollers for bearing against the flange of a beam or rail.

However, the foregoing devices have the disadvantages of being relatively heavy or complex devices which may not be rapidly and easily connected and disconnected from the rail. Since a worker is frequently carrying tools or other materials, it is desirable to minimize the load and weight of the safety device worn by him. A device which is relatively heavy becomes a load which must be dragged by the worker as he moves relative to the rail. Further, since the worker must often perform work at different locations along the railway track, it is desirable that he be able to quickly and easily connect and disconnect the device from the railway track for maximum flexibility.

Therefore, it is desirable that a railway safety anchor be durable, relatively lightweight and portable, and have ease and simplicity of operation.

The present invention seeks to obviate and mitigate the disadvantages of the prior art by providing a sliding rail anchor device for slidable mounting engagement with a rail of a railway track comprising: a pair of jaw-like members having an exterior surface and an interior surface, said jaw-like members being angularly configured to grasp and slidably engage the rail of a railway track within a longitudinal channel defined by the interior surfaces of said jaw-like members; hinge means pivotally interconnecting said jaw-like members; a locking arm secured to said jaw-like members, substantially normal to said channel, said locking arm comprising: a first plate having an upper portion with an aperture extending therethrough, and a lower portion; and a second plate having an upper portion with an aperture extending therethrough, and a lower portion; wherein said upper portions partially overlap each other enabling said apertures to be concentrically aligned to receive karabiner means, and said lower portions are respectively adjacent and secured to said exterior surface of said jaw-like members.

A preferred embodiment of the invention will now be illustrated with reference to the accompanying drawings, wherein FIG. 1 is a perspective view of an embodiment of the invention;

Figure 1:
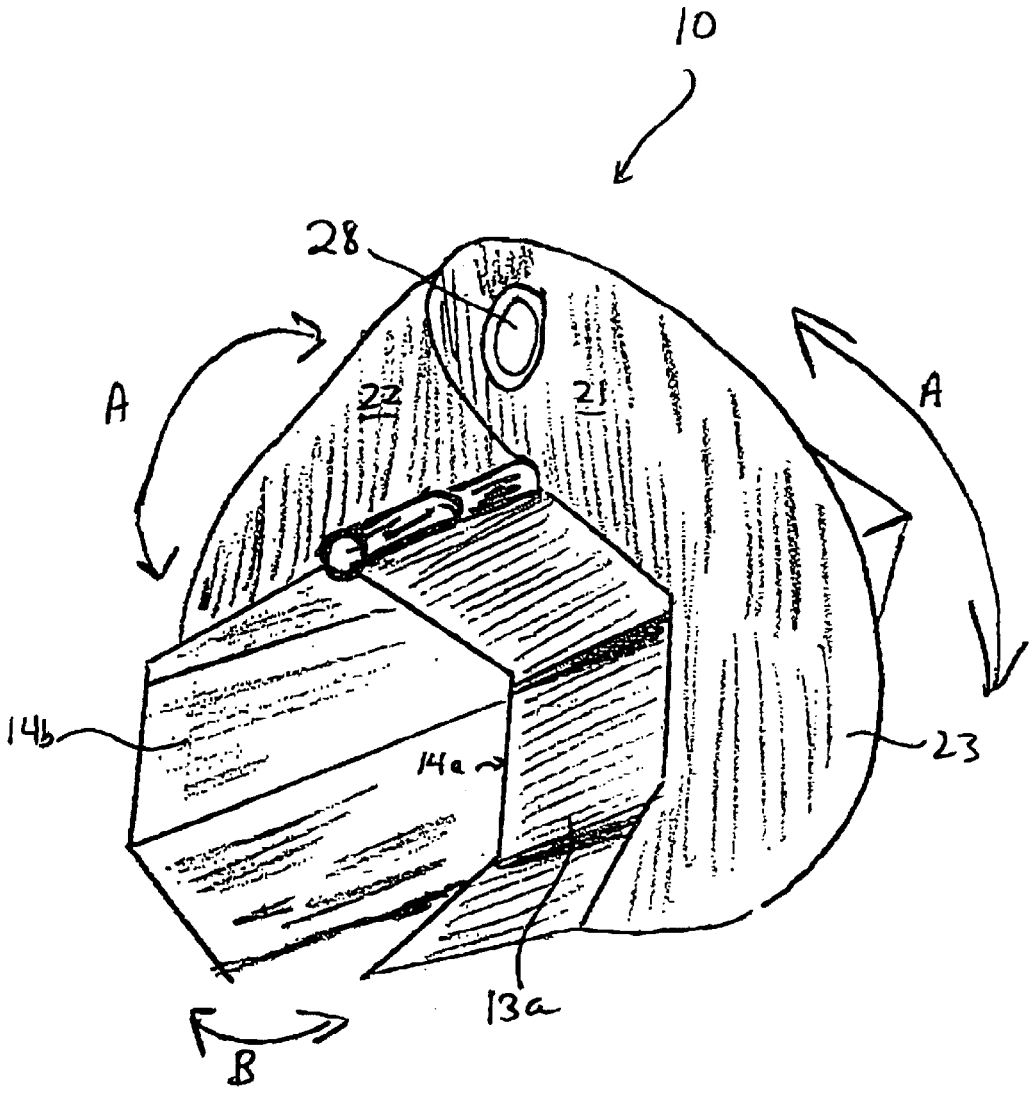
Figure 2:
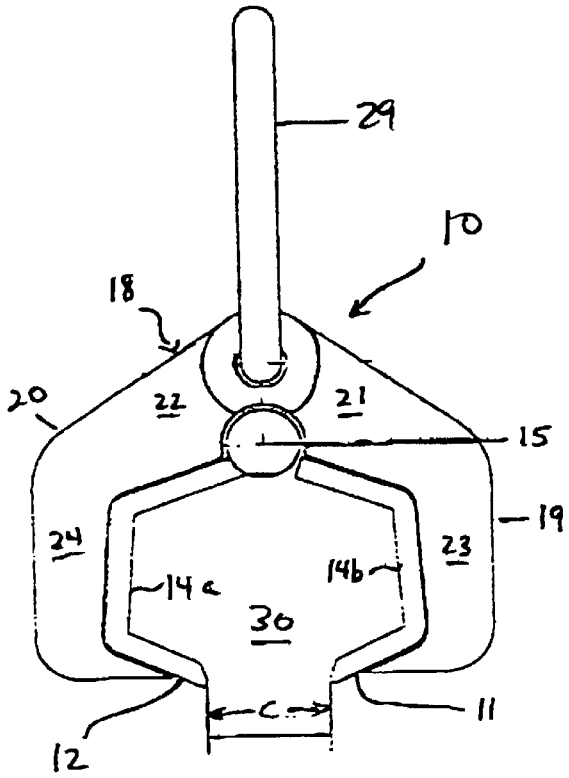
FIG. 2 is an end view of a preferred embodiment of the invention.
Figure 3:
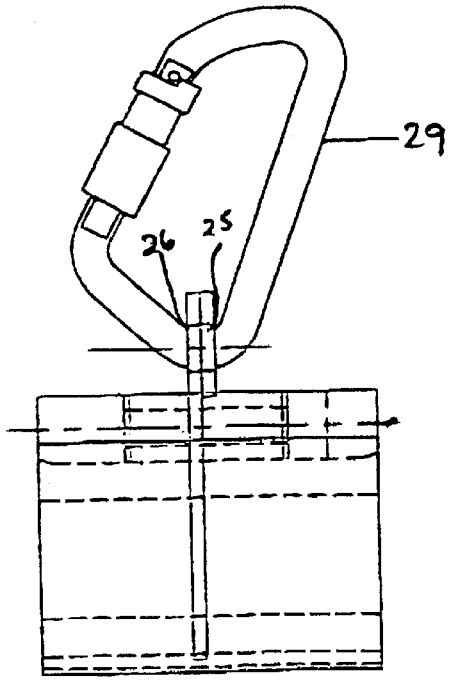
FIG. 3 is a side, cross-sectional view of a preferred embodiment of the invention.
Figure 4:
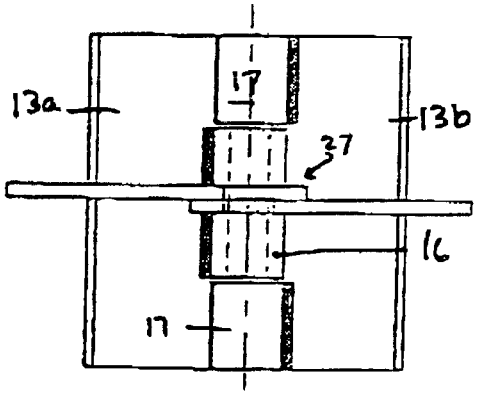
FIG. 4 is a top view of a preferred embodiment of the invention.

The safety device 10 of the invention comprises a pair of angularly configured jaw-like members 11, 12 having respective exterior surfaces 13*a* and 13*b* and respective interior surfaces 14*a* and 14*b*. Hinge means 15 comprising a pin 16 and a plurality of joints 17 pivotally interconnect jaw-like members 11, 12. Jaw-like members 11, 12 define a channel 30 which is configured to engage a rail of a railway track.

Locking arm 18 comprises a pair of plates 19, 20, each having respective upper portions 21, 22; lower portions 23, 24; and an aperture 25, 26. Lower portions 23, 24 are secured to the exterior surface of jaw-like members 11, 12 by welding or some other suitable means well-known to those skilled in the art, at an orientation which is substantially normal to the longitudinal axis of channel 30. Upper portions 21, 22 are partially overlapping, as shown at 27. The extent of the overlap will increase or decrease as jaw-like members 11, 12 are pivoted about hinge means 15. The pivoting of jaw-like members 11, 12 about hinge means 15 enables apertures 25, 26 to be concentrically aligned so as to define a bore 28 which receives a karabiner 29 from which can be attached a tether or line (not shown) which can in turn be attached to a belt, harness or other safety securement device.

In use, the pivoting of jaw-like members 11, 12, in the direction of arrows A opens or widens the diameter of channel 30, shown by arrow B, enabling the device 10 to be placed on the crown of a rail (not shown). The jaw-like members are then pivoted to a closed position characterized by the alignment of apertures 25, 26. In such a closed position, the device functions as a claw, grasping the rail such that the flanges of the rail are enclosed within channel 30. The diameter and configuration of the channel does permit a small amount of clearance so that the device can be slid along the rail, without becoming disengaged therefrom.

When retained within bore 28, karabiner 29 restricts the relative pivotal movement of plates 19 and 20 and prevents apertures 25, 26 from becoming disaligned. When apertures 25, 25 are not aligned, there is either considerable overlap between plates 19, 20, causing the claw to open with resultant widening of channel 30; or overlap is smaller than when the apertures are aligned, wherein there is a narrowing of channel 30. If the channel is too wide, the device will not be securely retained against the rail. Where the channel is too narrow, the interior surface of jaw-like members will bear against the flange of the rail, but there will be insufficient clearance between the rail and the device to enable the device to operatively slide along the rail. The diameter of channel 30 at its narrowest point, shown as C, should not exceed 1.50 inches.

The alignment of apertures 25, 26 therefore provides a quick and convenient means to operatively align and secure the device to a rail without the inconvenience of adjusting nuts, bolts or other more complex securement and alignment means characterized by prior art devices.

In a preferred embodiment, the device is manufactured from 304 stainless steel or other material of adequate tensile strength, which will be readily known and selected by those skilled in the art, and can be used on 80 lb. to 135 lb. rail.

What is claimed is:

1. A sliding rail anchor for use on a rail comprising: an elongated hinge including first and second hinge members having a pair of seamless tubular outer members and an intermediate seamless tubular member welded to the first and second hinge members, respectively, and defining a cylindrical barrel pivotally interconnected by a hinge pin extending from end to end and secured to the cylindrical barrel by welding;

said first and second hinge members defining opposed longitudinally extending portions of C-shaped cross-section for engaging a head portion of a railroad track;

a first C-shaped plate secured perpendicular to an outer face of one said C-shaped cross near its midpoint, and a second plate secured perpendicular to another outer face of another one of said C-shaped cross so as to overlap said first plate;

said first and second plates extending above said hinge pin;

and having apertures adapted to be aligned when anchor is in an operative position on said head portion of said rail for receiving;

a self locking karabiner ring inserted in said aligned apertures; and a safety line is secured to said karabiner ring which in turn secured to a safety harness of a workman.

* * * * *